US007524215B2

(12) United States Patent
Banas et al.

(10) Patent No.: US 7,524,215 B2
(45) Date of Patent: Apr. 28, 2009

(54) APPARATUS, ARTICLES OF MANUFACTURE AND METHOD FOR A WIRE DRESS COVER ASSEMBLY

(75) Inventors: Michael H Banas, Kernersville, NC (US); David A Klein, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/268,424

(22) Filed: Nov. 7, 2005

(65) Prior Publication Data

US 2006/0051992 A1 Mar. 9, 2006

Related U.S. Application Data

(63) Continuation of application No. 10/377,199, filed on Feb. 28, 2003, now abandoned.

(51) Int. Cl.
*H01R 13/514* (2006.01)

(52) U.S. Cl. ..... 439/731; 439/465; 439/687

(58) Field of Classification Search ..... 439/731, 439/687, 465, 906, 535, 690; 220/326, 394
See application file for complete search history.

(56) References Cited

U.S. PATENT DOCUMENTS 4,749,369 A * 6/1988 Wang ..... 439/459
5,052,949 A * 10/1991 Lopata et al. ..... 439/610
5,788,534 A * 8/1998 Koegel et al. ..... 439/465
5,807,141 A * 9/1998 Sexton ..... 439/652
6,095,852 A * 8/2000 Gregory, II ..... 439/540.1
6,309,257 B1 * 10/2001 Huang ..... 439/731
6,398,594 B1 * 6/2002 Bonilla et al. ..... 439/731
6,599,151 B2 * 7/2003 Chiran et al. ..... 439/610
6,692,278 B2 * 2/2004 Abadia et al. ..... 439/287
6,695,639 B2 * 2/2004 Castaldo et al. ..... 439/467
7,021,959 B2 * 4/2006 Tsuji et al. ..... 439/470
7,140,905 B2 * 11/2006 Castaldo ..... 439/410

* cited by examiner

*Primary Examiner*—Hien Vu

(57) ABSTRACT

An electrical connector assembly includes an electrical connector with one or more latch receptacles, and a cover with one or more latches, in which the latch receptacles and latches are polarized so that a latch engages with a latch receptacle when the connector and the cover are aligned in a pre-determined orientation. In certain embodiments, the electrical connector has at least two latch receptacles, one of them being a first width and others being of a second, different width, and there are corresponding latches also of two different widths. In certain embodiments, the latches are in pairs, and for example, at least one pair of latches and receptacles of the same width will be on opposite sides of the cover. The pairs differ in width so that the cover is "polarized" to fit in only one orientation.

16 Claims, 6 Drawing Sheets

APPARATUS, ARTICLES OF MANUFACTURE AND METHOD FOR A WIRE DRESS COVER ASSEMBLY

This application is a continuation under 37 CFR 1.53(b) of, and claims priority from, patent application Ser. No. 10/377,199 filed Feb. 28, 2003 now abandoned.

FIELD OF THE INVENTION

The present invention relates generally to electrical connectors, and more particularly to electrical connector assemblies.

BACKGROUND OF THE INVENTION

Electrical connectors are utilized for many purposes. Most, if not all, electrical connectors provide an electrical pathway or junction, and in so doing provide a mechanical connection between wires, circuit leads, components or other current carrying features. In addition, electrical connectors are often attached to another assembly, and with the electrical connection protected from the environment, which in some cases includes shielding from interference. Thus, there is a large category of connectors that comprise a connector base or "block" into which the electrical connections are made, and a cover or similar feature that permits assembly and subsequent access. The cover must be affixed sufficiently to remain in place while in use, but is also typically removable for subsequent access. The cover must also adequately seal out any environmental effects, and in the case of a shielding cover, provide appropriate protection from unwanted interference.

Because a connector cover is often installed and removed multiple times during assembly, and subsequently installed and removed in the field for inspection, maintenance and repair, it is important to provide a cover that has easily operable fasteners. It is additionally desirable to provide a cover for a connector that cannot be installed improperly, thereby ensuring that the functions of environmental protection and shielding are not compromised. However, many current connector and cover assembly designs are inadequate or do not carry out all these functions equally well. There exists, therefore, a need to provide an improved connector and cover assembly that improves upon the shortcomings of the prior art.

SUMMARY OF THE INVENTION

An embodiment of an electrical connector assembly is disclosed that includes a defined number of latch receptacles and a cover with corresponding latches, and with the latch receptacles and latches preferably being polarized, so that a latch engages with a latch receptacle when the connector and the cover are aligned in a pre-determined orientation. In certain embodiments, the electrical connector has at least two latch receptacles, one of them being a first width and others being of a second, different width, and there are corresponding latches also of two different widths. In certain embodiments, the latches are in pairs, and for example, at least one pair of latches and receptacles of the width will be on opposite sides of the cover. Embodiments are further usefully applied where the cover is substantially square, and in such embodiments, pairs of latches and receptacles can be placed on opposite sides, and the pairs differ in width so that the cover is "polarized" to fit in only one orientation. In this and in similar embodiments, it may be desirable to position pairs of connectors to be symmetrical about an axis. In this and in similar embodiments, it may be desirable to position pairs of connectors to be symmetrical about an axis. In certain embodiments, it is preferred that the connector assembly be molded from a thermoplastic material, and most preferably a fiber composite material, although other suitable materials may also be utilized as well where desired. In an embodiment illustrated herein, nylon filled with glass fibers is utilized.

In another exemplary embodiment, an electrical connector assembly is disclosed that has an electrical connector block and a cover along with a plurality of latches and a plurality of latch receptacles. The latch receptacles and latches are polarized so that a latch engages with a latch receptacle when the connector block and the cover are aligned in a pre-determined orientation.

In certain embodiments, the electrical connector assembly may be held together by latches that are flexible members having an engaging section disposed on a distal end, and with the latch receptacles including a feature for connection on either side of center with the engaging section after the latch is displaced from a first position to a second position.

Methods of assembling a cover to a connector are also disclosed. In one embodiment, the cover is oriented in the correct polarity by positioning first and second latches of different widths in correspondence with first and second latch receptacles, and then pressing the cover into an assembled position, so that the latches deflect and then engage corresponding ones of the latch receptacles.

DETAILED DESCRIPTION

Figure 1:
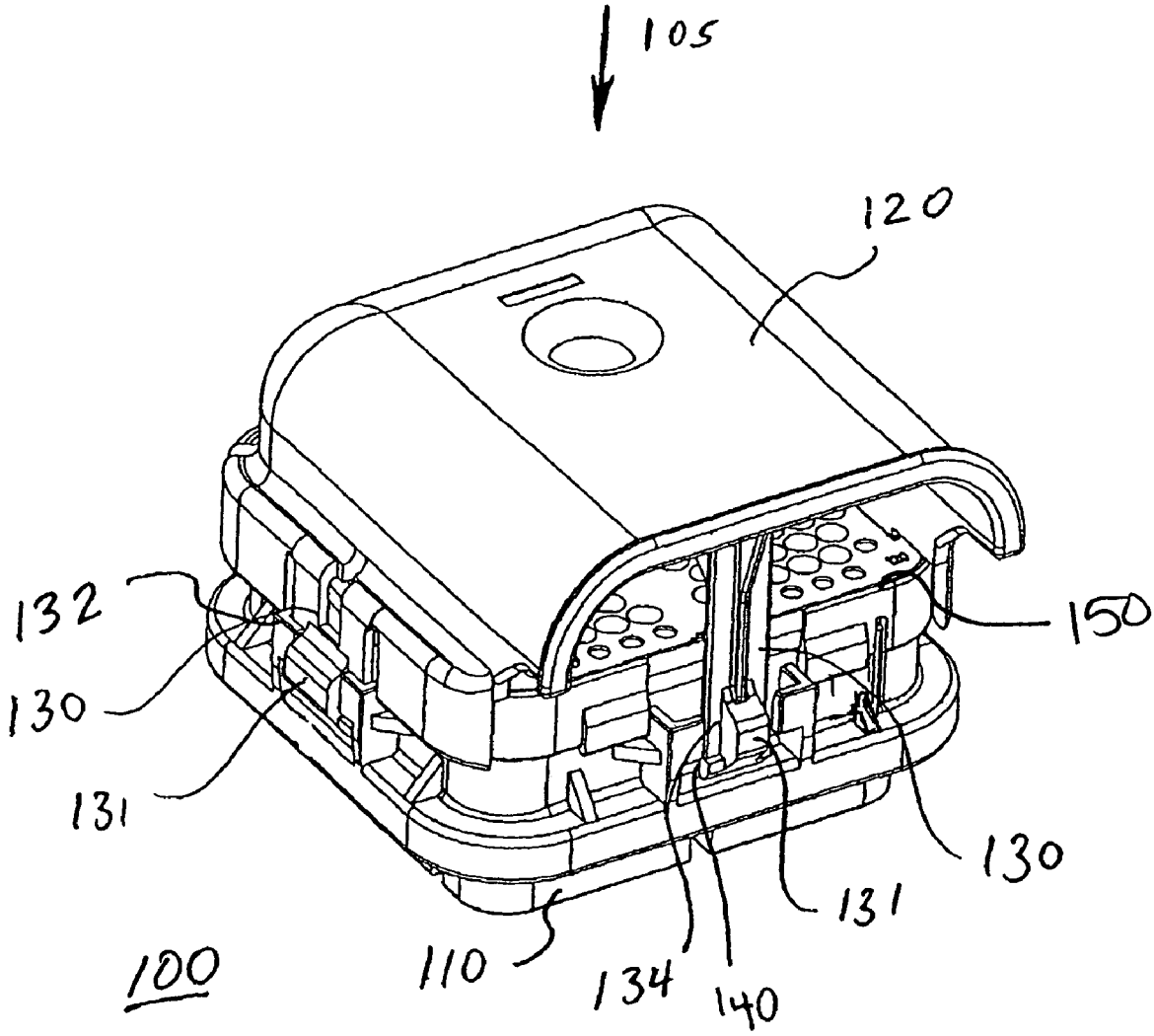
FIG. 1 is a front perspective view of a connector and cover assembly in accordance with an embodiment of the present invention.

Referring now to the drawings in detail, wherein like reference numerals indicate like elements throughout the several views, there is illustrated in FIG. 1 a front perspective view of a connector assembly 100 in accordance with an embodiment of the present invention. In this embodiment, the connector assembly 100 comprises a connector 110 and a cover 120. In the exemplary embodiment illustrated in FIG. 1, the connector 100 is preferably a wire dress block adapted for providing an interconnection point for electrical wires. The cover 120 in this embodiment is generally elongated and preferably a shell, and does not include any mechanical or electrical connection features. In other embodiments, the connector 110 and/or the cover 120 may carry electrical components and/or provide electrical connections where desired. The present embodiment also preferably includes one or more latches 130, which are disposed along the sides of the assembly 100 in the embodiment illustrated in FIG. 1. In the present embodiment, the latches are generally rectangular in configuration and attached at one end to the cover 120. It should be noted that in certain embodiments, the latch 130 will have different widths embodiment, wherein the latches are generally rectangular, the parallel sides of the generally rectangular configuration of the latches will have narrower latches than the one parallel sides of the generally rectangular configuration of the latches. In the exemplary embodiment of FIG. 1, a plurality of latches 130 are provided, and at least one, and preferably each of the latches 130 corresponds to and is in registration with a latch receptacle 140, which is generally rectangular in this embodiment. For assembly of the connector 110 and cover 120 in this embodiment, the cover 120 is preferably moved downwardly in the direction of arrow 105, so that the resilient latches 130 contact against the connector 110 deflecting inwardly, and then back toward their original position to engage in the corresponding latch receptacles 140, locking the two components together when the cover 120 is in its final, closed position.

As shown in FIG. 1, the latches 130 preferably include an engagement feature 131 disposed on their distal ends that engage latch receptacles 140 on both sides of center. In the present embodiment, the engagement feature 131 comprises a generally elongate boss extending from an outer surface of latches 130 primarily intended for ease of disengagement of the latches when depressed between the engaging surfaces of the receptacle features. Although it should be understood that any suitable design may be used for such engagement feature and corresponding latch receptacle, as are well known to those of ordinary skill in the art.

In the present embodiment, preferably the latch structures exhibit low stress so as to reduce fatigue failure, while permitting high deflection to provide adequate latching functionality. Further, it is preferred in this embodiment that latches 130 are resilient enough to be easily engaged and disengaged, yet strong enough to preclude inadvertent or unintended release. In alternate embodiments beyond that shown in FIG. 1, the latch and receptacle structures may be interchanged. In other words, in certain embodiments, the latch(es) will extend from the connector and the cover will include the latch receptacle(s) or an equivalent feature. As will be described in more detail below, four latches 130 are illustrated in the present embodiment, defined by a pair of latches 132, a latch 133 and a latch 134.

Figure 2:
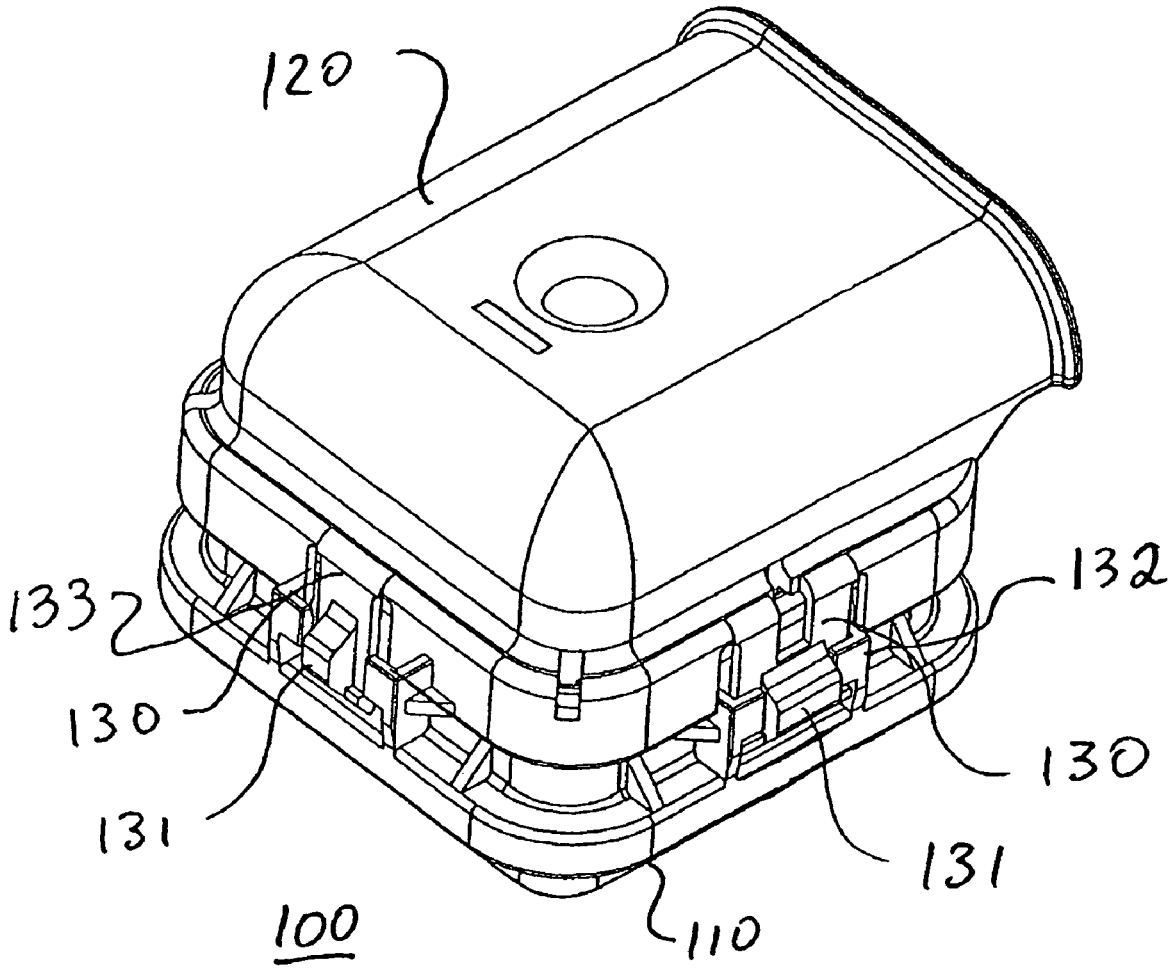
FIG. 2 is a rear perspective view of the assembly shown in FIG. 1.

Referring now to FIG. 2, there is illustrated a rear perspective view of the connector assembly 100 shown in FIG. 1. In this view, one of the pair of latches 132 is shown, which is located at the far right. This same latch 132 is also shown in FIG. 1 but viewed from a different perspective, which is located at the far left. In the illustrated embodiment, as explained in detail below, a pair of corresponding latches 132 are provided disposed on directly opposite sides on cover 120. Also shown in FIG. 2, latch 133 is provided, which is located directly opposite the latch 134 shown in FIG. 1.

Figure 3:
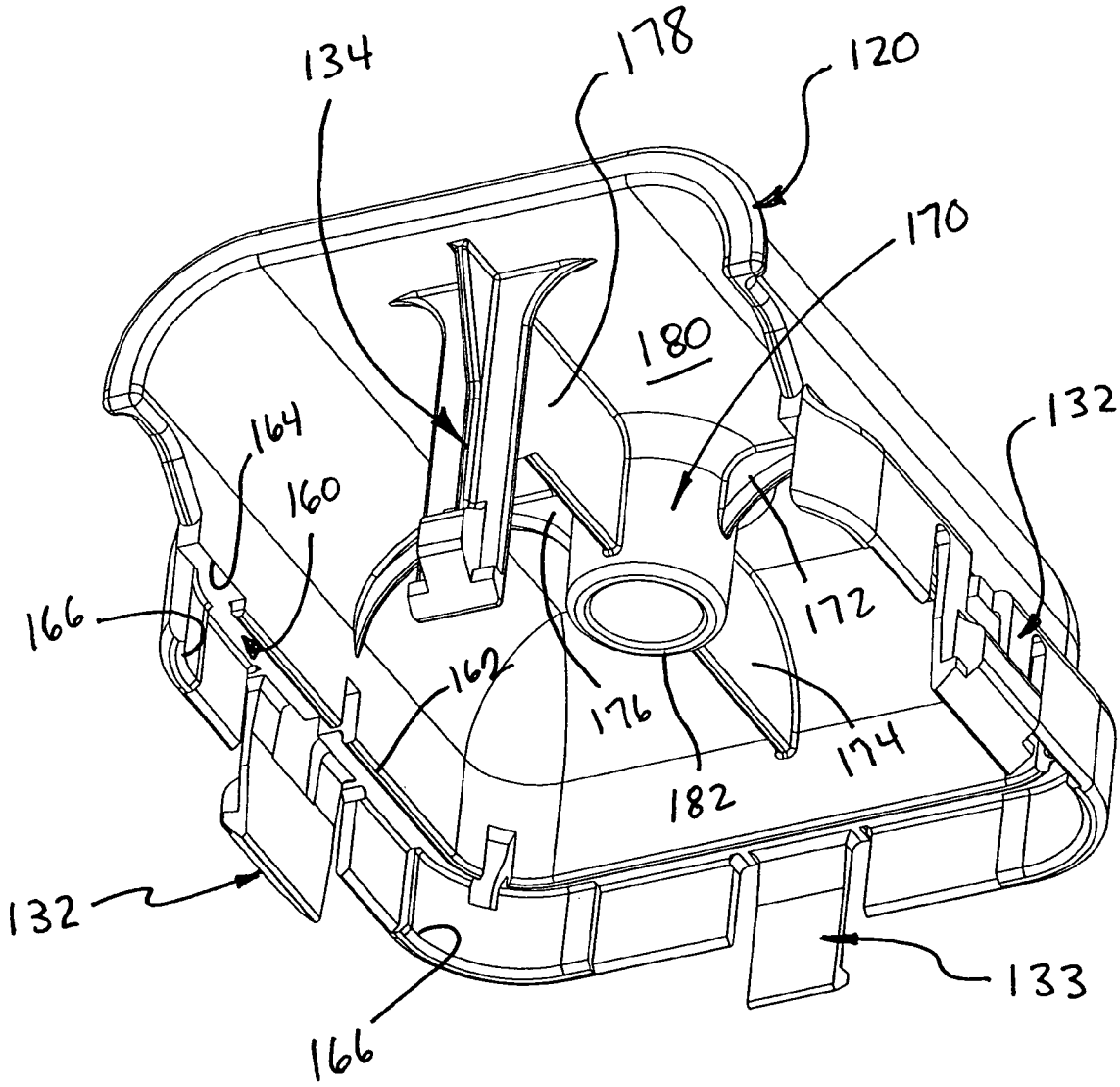
FIG. 3 is a front perspective view of a cover shown in FIG. 1.

As illustrated in FIG. 3, the placement of the various latches 130 is shown by a perspective view of the cover 120 from the "underside" or interior of the assembly. The pair of latches 132 disposed opposite one another are identical in this embodiment, and the other two latches 133, 134 are arranged opposite one another but differ in design due to the differences in the cover 120 at the location where each latch 133, 134 is located. In accordance with one aspect of the present embodiment, it is preferred that the width of the first pair of latches 132 differ from the width of the other latches 133, 134. By making each pair of opposing latches with a different width, the cover 120 is "polarized" with respect to the connector 110, in that there is one and only one way to affix the two portions together, so that latches 130 will properly engage the receptacles 140 and not be damaged or misaligned.

Figure 4:
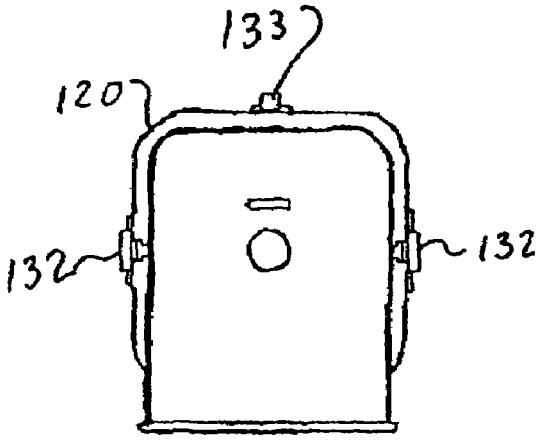
FIG. 4 is a top plan view of the cover shown in FIG. 3.
Figure 5:
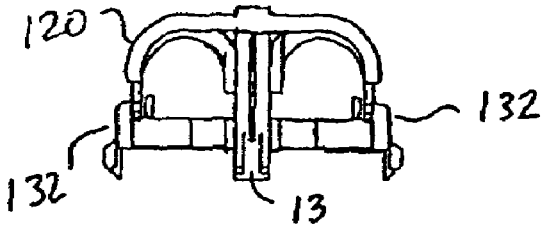
FIG. 5 is a rear elevational view of the cover shown in FIG. 4.
Figure 6:
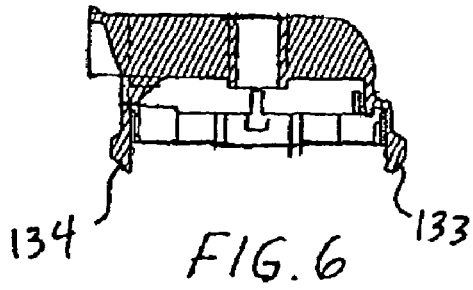
FIG. 6 is a left side elevation view, partially in cross-section, of the cover shown in FIG. 4.

The differential latch width described above, as well as further features of an exemplary embodiment of the invention are seen in FIGS. 4-6. In FIG. 4, a top plan view of the cover 120 is shown and the opposite pair of latches 132 of a first width is seen, along with the latch 133 of a different width. Turning to FIG. 5, a rear elevational view shown illustrates the fourth latch 134 that is aligned with, opposite and the same width as the latch 133, which is a different width than that of the latches 132 disposed along adjacent sides. Finally, a left side elevational view is illustrated in FIG. 6, which is in cross-section, showing the manner by which latches 133,134 are aligned opposite one another, and although different in length, extend to the same latch depth and have similar sized elements.

In addition to the general mechanical design considerations described above by which the design disclosed herein provides a low stress, high deflection latch, the device preferably also has high strength, which is primarily a function of material selection. A preferred material for use in the illustrated embodiment is nylon or Poly(p-phenylene sulfide) (PPS). PPS is a highly stable polymer in terms of both thermal degradation and chemical reactivity. PPS is a semi-crystalline polymer with a high crystalline melting point of about 285.degree. C. (545.degree. F.). Because of its molecular structure, PPS also tends to char during combustion, making the material inherently flame retardant. PPS does not dissolve in any solvent at temperatures below about 200.degree. C. (392. degree. F.). When blended with glass fibers and other fillers, PPS has both long-term and short-term thermal stability, high modulus and creep resistance, high resistance to aggressive chemical environments, permits precision molding to tight tolerances with high reproducibility, has inherent non-flammability, and good insulating properties over a wide range of conditions PPS is available commercially under the trade name Ryton.™. from the Chevron Phillips Chemical Company LP, P.O. Box 4910, The Woodlands, Tex. 77387-4910. Glass-filled PPS is also sold commercially by Ensinger GmbH, Rudolf-Diesel Str. 8, 71154 Nufringen, Germany under the trade name "Tecatron." A product called "Tecatron GF 40" contains 40% glass fibers and is a preferred material for use with the invention. As should be understood, however, any other suitable materials may also be utilized where desired for these same purposes.

Figure 8:
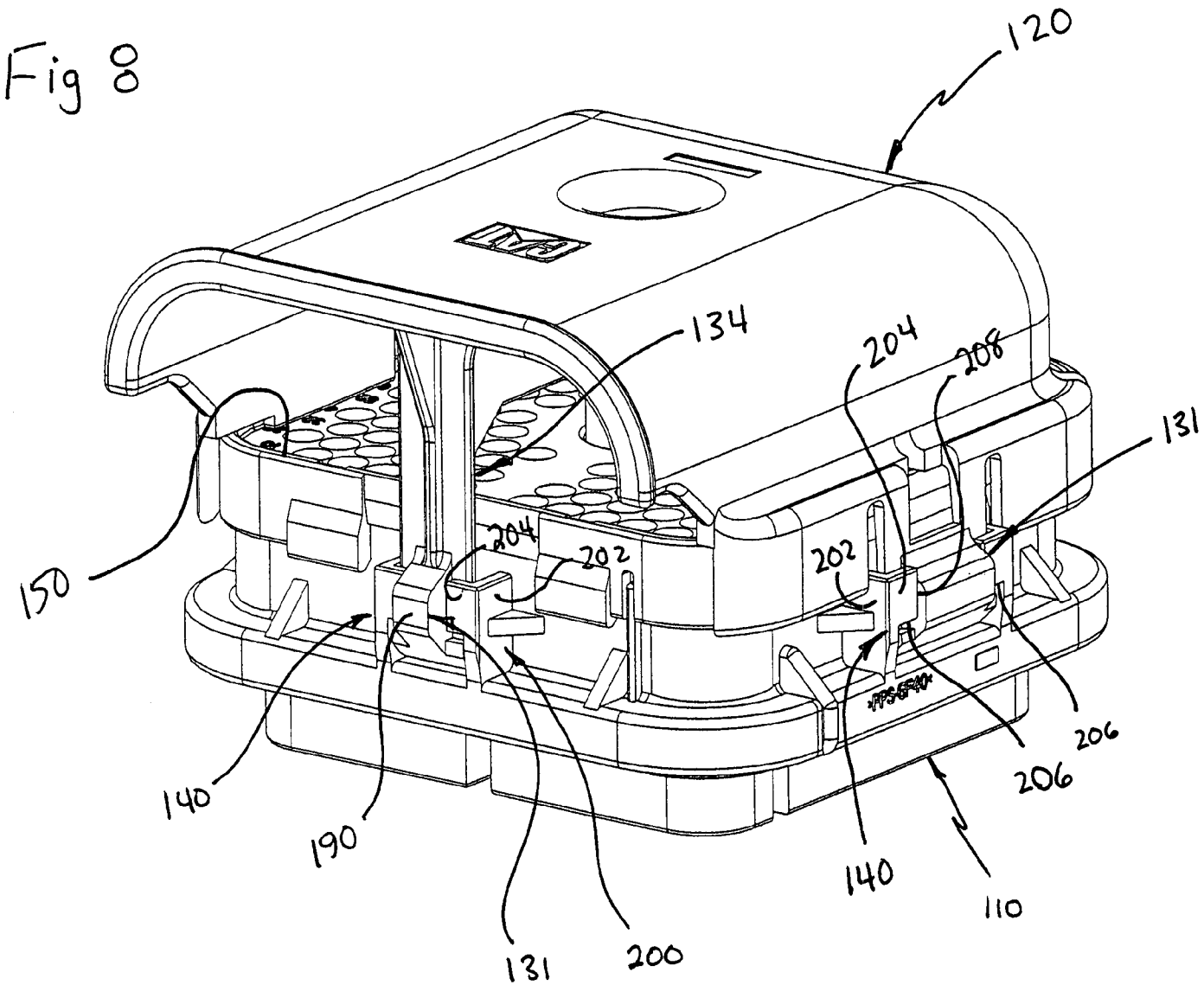
FIG. 8 shows a perspective view similar to FIGS. 1 and 2.

With reference now to FIGS. 1 and 8, the connector 110 includes an upper rim or ridge 150 upon which the cover 120 is fitted. With respect again to FIG. 3, cover 120 includes a channel 160 which is defined by a downwardly extending ridge 162, which extends downwardly from an engagement surface 164. A peripheral wall 166 circumscribes the engagement surface 164 to form channel 160 therein. It should be appreciated that the channel 160 is profiled to cooperate with the upper rim 150 as is apparent from FIGS. 1 and 8.

With reference again to FIG. 3, a rigidified post 170 is provided having a plurality of rigidifying ribs 172, 174, 176 and 178. As shown, rigidifying rib 178 extends to latch member 134. All of the rigidifying ribs 172-178 are interconnected between the post 170 and an internal surface 180 of the cover 120. Post 170 further includes an engagement surface at 182 profiled to provide support for the cover member, by contacting the connector 110.

Figure 7:
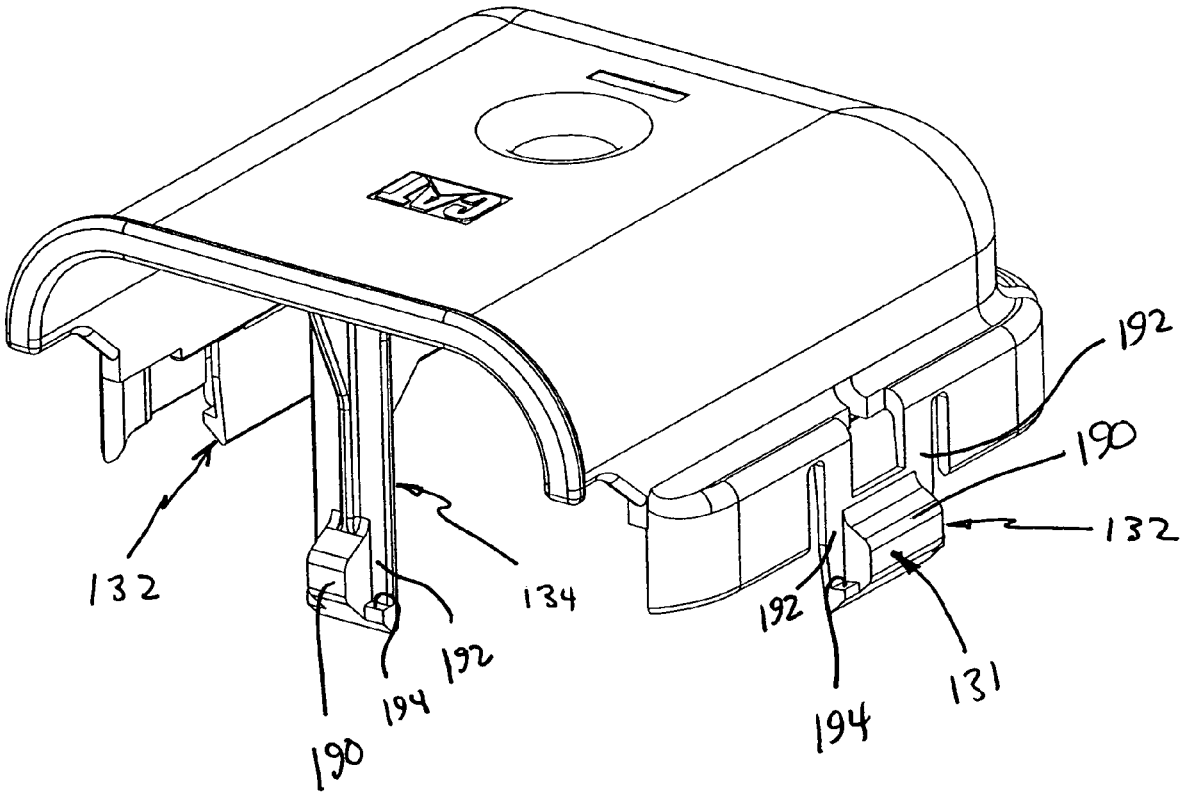
FIG. 7 shows a front perspective view of the cover of FIG. 1 removed.

With reference now to FIG. 7, the latches 132-134 will be described in greater detail. As mentioned above, each of the latches include an engagement portion 131. Although differently configured, each engagement portion 131 includes an enlarged boss 190 which provides an enlarged surface for contacting to depress the latch, and each boss 190 is flanked by vertical surfaces 192 which terminate into upwardly facing latching surfaces 194. With respect again to FIG. 8, each of the latch and receptacles 140 include opposing L-shaped walls 200 defined by walls 202 which extend outwardly from the connector housing 110 and wall portions 204 which extend parallel to the housing 110. Walls 204 define latching surfaces 206 and a passage 208 for the bosses 190.

As defined, the cover 120 is both robust and easy to use. In the event that a large force is exerted on top of the cover 120, for example someone stepping on the cover while the unit to which it is attached is being maintained, the cover is supported by way of the channel 160. This prevents the various latches 132-134 from being stressed and broken because the force of the weight is taken up between surface 164 and upper rim 150. Furthermore post 170 can be positioned against a surface of the connector 110 to also provide support to the cover member 120. Finally the cover 120 is easy to use as the bosses 190 protrude through openings 208 to provide a large surface against which an operator can depress, to disengage the surfaces 194, 206 for removal of the wire dress cover 120.

The embodiments disclosed herein also presents improved methods for assembling a connector and cover by providing at least two latch structures of different widths arranged, so that the cover is "polarized" and can be placed on the connector in only one orientation. In particular, in certain embodiments, two pairs of latches disposed on opposite sides of a substantially square housing are provided. In this particular embodiment, possible confusion or improper installation of the cover is precluded due to the polarized latch arrangement. In such embodiments, placing the latches in a symmetrical manner and using only the width of the latches as the polarization "key" aid manufacturing the components and tolerance control.

Upon review of the foregoing, numerous adaptations, modifications, and alterations will occur to the reviewer. These will all be, however, within the spirit of the invention. For example, in other embodiments, latches 132 and/or latches 133, 134 can be positioned so that they are not located directly opposite each other. In other words, located at any position on cover 120 and/or connector 110. In addition, the polarization feature may be based on characteristics other than width of the latches 130/receptacles 140, such as, for example, shape, depth, etc. In addition, while in the illustrated embodiment, each of the latches 130/receptacles 140 serves as a polarization feature, this may be varied in other embodiments to include fewer than all, in particular, any desired number of latches 130/receptacles 140. Accordingly, reference should be made to the appended claims in order to ascertain the true scope of the present invention.

We claim:

1. An electrical connector assembly, comprised of an electrical connector housing and cover, the electrical connector housing comprising a wire exit face, the cover comprising a channel portion positioned about an interior periphery of the cover, the channel portion being profiled to reside over a top rim of the electrical connector housing, said channel portion is defined by an inner lip profiled to reside on the interior of said top rim, and an outer wall profiled to circumscribe said top rim of said electrical connector housing, with an engagement surface therebetween, said cover is defined as a wire dress cover profiled for placement over said wire exit face with an opening though an end of said cover, the cover further comprising latches in latching engagement with the electrical connector housing, wherein one of said latches extends down from the cover through said wire dress opening and another latch extended downwardly from opposite side of said wire dress opening.

2. The electrical connector of claim 1, wherein said latches extend downwardly from said outer wall.

3. The electrical connector of claim 1, further comprising a post extending downwardly from an interior surface of said cover, and being profiled to support said cover from an interior thereof.

4. The electrical connector of claim 3, wherein said housing includes latch receptacles for mating with the latches extending from the cover.

5. The electrical connector of claim 4, wherein said latching receptacle for said one latch comprises a stop surface for supporting said one latch.

6. The electrical connector of claim 5, wherein said cover further comprises at least one rigidifying rib extending between an inner surface of said cover and said post.

7. The electrical connector of claim 6, wherein said rigidifying rib extends between said post and an interior surface of said one latch.

8. An electrical connector assembly, comprised of an electrical connector housing and cover, the cover comprising a channel portion positioned about an interior periphery of the cover portion, the channel portion being profiled to reside over a top rim of the electrical connector housing, said cover being defined as a wire dress cover with an opening though an end of said cover and profiled to receive a plurality of wires therethrough, thereby defining a wire dress opening between the cover and the housing, the cover further comprising a post extending downwardly from an interior surface thereof, and being profiled to support said cover from an interior thereof, said connector housing and cover further comprising a plurality of complementary latches wherein one of said latches extends down from the cover through said wire dress opening and another latch extended downwardly from opposite side of said wire dress opening.

9. The electrical connector of claim 8, wherein said cover further comprises at least one rigidifying rib extending between an inner surface of said cover and said post.

10. The electrical connector of claim 9, wherein said rigidifying rib extends between said post and an interior surface of said one latch.

11. The electrical connector of claim 8, wherein said channel portion is defined by an inner lip profiled to reside on the interior of said top rim, and an outer wall profiled to circumscribe said top rim of said electrical connector housing, with an engagement surface therebetween.

12. The electrical connector of claim 11, wherein said latches extend downwardly from said outer wall.

13. An electrical connector assembly, comprised of an electrical connector housing and cover, the cover comprising a wire dress opening extending through an end thereof, and the electrical connector housing further comprising a latching assembly in latching engagement with the electrical connector housing, the latches being profiled as latching arms extending from said cover with enlarged bosses flanked by latching surfaces, and said latching assembly further comprising a latch receptacle, defining an opening through which said enlarged bosses extend, wherein at least one of said latches extends down from the cover through said wire dress opening, and said latch receptacle comprising a stop surface for supporting said one latch and another latch extended downwardly from opposite side of said wire dress opening.

14. The electrical connector of claim 13, wherein the electrical connector housing further comprises a post extending downwardly from an interior surface of said cover, and being profiled to support said cover from an interior thereof.

15. The electrical connector of claim 14, wherein said cover further comprises at least one rigidifying rib extending between an inner surface of said cover and said post.

16. The electrical connector of claim 15, wherein said rigidifying rib extends between said post and an interior surface of said one.

* * * * *